US005465301A

United States Patent [19]

Jotcham et al.

[11] Patent Number: 5,465,301

[45] Date of Patent: Nov. 7, 1995

[54] SECURITY THREADS

[75] Inventors: Richard B. Jotcham, Wiltshire; Gerald S. Payne, Bath, both of United Kingdom

[73] Assignee: Portals (Bathford) Limited, Bath, United Kingdom

[21] Appl. No.: 183,342

[22] Filed: Jan. 19, 1994

[30] Foreign Application Priority Data

Jan. 20, 1993 [GB] United Kingdom ..... 9300998

[51] Int. Cl.[6] ..... H04L 9/00; B42D 15/00

[52] U.S. Cl. ..... 380/54; 380/59; 283/72; 283/85

[58] Field of Search ..... 162/104; 283/83, 283/85, 89, 72; 427/148; 428/199, 913, 195; 380/54, 59

[56] References Cited

U.S. PATENT DOCUMENTS

| | | | |
|---|---|---|---|
| 4,028,118 | 6/1977 | Nakasuji et al. | 428/913 |
| 4,037,007 | 7/1977 | Wood | 428/199 |
| 4,425,161 | 1/1984 | Shibahashi et al. | 427/148 |
| 4,451,521 | 3/1984 | Kaule et al. | 428/199 |
| 4,897,300 | 1/1990 | Boehm | 428/195 |
| 4,921,280 | 5/1990 | Jalon | 283/89 |
| 5,002,636 | 3/1991 | Crane | 162/104 |
| 5,093,184 | 5/1992 | Edwards | 283/83 |
| 5,219,625 | 6/1993 | Matsunami et al. | 428/913 |
| 5,260,582 | 11/1993 | Danek et al. | 283/85 |
| 5,308,992 | 5/1994 | Crame et al. | 250/556 |
| 5,324,567 | 6/1994 | Bratchley et al. | 283/72 |
| 5,413,839 | 5/1995 | Chatwin et al. | 428/195 |

*Primary Examiner*—Salvatore Cangialosi
*Attorney, Agent, or Firm*—Watson, Cole, Grindle & Watson

[57] ABSTRACT

A security thread (11) for use in security articles (10), includes a substrate having a coating on one or both sides thereof, the coating containing a thermochromic material selected from pigments and dyestuffs which changes from coloured to colourless when the temperature of the pigment or dyestuff is changed to the activation temperature. The thermochromic material may be coloured when the temperature is below the activation temperature and become colourless when the material is at the activation temperature or above. The thread (11) is for security paper (10) for use in producing banknotes and the like.

63 Claims, 1 Drawing Sheet

SECURITY THREADS

BACKGROUND OF THE INVENTION

1. Field of the Invention

The invention is concerned with security threads for security articles such as banknotes, cheques and the like.

2. The Prior Art

It is widely to known to use in banknotes security strips or threads which are made from a transparent film provided with a continuous reflective metal layer, vacuum deposited aluminium on polyester film being the commonest example. Banknotes made from such paper have been in general circulation in many countries for many years. When such security devices are embedded in a security paper and the paper is subsequently printed to provide the security document, e.g. a banknote, the thread cannot be readily discerned in reflected light but is immediately apparent as a dark image when the document is viewed in transmitted light. Such threads are extremely effective against counterfeiting by printing or photocopying, since the optically variable effect which is provided cannot be accurately simulated, for example by printing a line on the paper.

The composition, size and positioning of security threads currently in use vary depending on the desired security of the document. Typical security threads are composed of a polymeric film such as polyester, which may be metalised or coloured and may include microprinted lettering denoting a title or message. The lettering can be produced by printing onto the substrate or by de-metallising a metallic layer on the substrate. One example of microprinted thread can be found in British patent specification No. 1095286. The threads can be slit to produce either registered lettering with respect to the edge of the thread, or unregistered lettering designed so that the message always appears in respect of thread slitting.

The widths of threads typically used vary from 0.5 mm to 2 mm and may have thicknesses typically ranging from 12 microns up to 50 microns.

The positioning of the thread within the document may be strictly controlled to agreed criteria and may be concurrent with additional security features, such as watermarks. Security threads may be fully embedded within security paper in such a way that paper fibres cover both sides of the thread, making it considerably less visible in reflective light, but clearly visible in transmitted light.

In recent times, however, in order to enhance security documents against modern counterfeiting techniques making use of sophisticated colour separation, printing and colour photocopy technology, it has become common to use a security thread comprising a thin layer of aluminium on a plastic support which is exposed on one side of the sheet at intervals along the length of the thread, the region of exposure being referred to as a window. British Patent Specification Nos. 1552853 and 1604463 disclose banknotes containing such windows. Paper for use in producing such banknotes can be made using the method disclosed in European Patent Specification No. 0059056. The dimensions of the windows typically used are from 3 mm to 14 mm lengthways, with bridges ranging from 4 mm to 30 mm therebetween. Again, the positioning of the windows may be controlled to allow registration of the window with respect of the document and other security features such as watermarks.

This latter development has resulted in enhanced security and windowed paper has been used for banknotes by many countries. A banknote of this type provides added security against counterfeiters as, when viewed in transmitted light, the strip is seen as a dark line and when viewed in reflected light on the appropriate side, the bright shining aluminium portions which are exposed at the windows are readily visible. However, there is a need for even greater security by the use of more sophisticated security devices in order to render the task of a would-be counterfeiter more difficult as the reflected light appearance of the exposed aluminium portions of a security device can be simulated to a degree by modern materials and techniques, for example by the use of hot foil stamping.

Other threads in use can be coated with protective lacquers and these may contain, for example, fluorescent inks which are only visible on illumination with ultra violet light of a specific wavelength, e.g. 366 nm.

It is also possible to make threads that are machine readable by incorporating into or onto the substrate, substances which can be identified by a detector, such as magnetic material.

Other known threads can be a single layer or multiple layers bonded or laminated together, and in some instances each layer may be coated with metal such as aluminium, stainless steel, tin and/or metal oxide such as tin oxide. The coating may be protected with the lacquer which may also contain coloured or invisible fluorescent pigment, for example rare earth chelates, such as europium acetylacetonate and the like.

SUMMARY OF THE INVENTION

The present invention is concerned with providing a security thread of enhanced security to provide security articles such as banknotes, cheques and the like which is even more difficult to counterfeit than the present banknotes containing windowed thread.

The present invention provides a security thread for use in security articles, the thread comprising a substrate having a coating on one or both sides of the substrate, the coating containing a thermochromic material selected from pigments and dyestuffs which material changes from coloured to colourless when the temperature of the pigment or dyestuff is changed to an activation temperature.

According to the invention there is provided in a second aspect a security thread for use in security articles, the thread comprising a substrate having a coating on one or both sides of the substrate, the coating containing a thermochromic pigment or dyestuff which is coloured when the temperature of the coating is below an activation temperature and which becomes colourless when the coating is warmed to the activation temperature or above.

Preferably the substrate is printed with indicia beneath the coating, the colour of the indicia being such that when the thermochromic coating becomes colourless the indicia are revealed.

In a first preferred embodiment of the invention one or both sides of the substrate have a metallised coating, which is partially demetallised to provide the indicia, and the coating containing the thermochromic material is provided on one side of the substrate such that at a temperature below the activation temperature the thread when viewed from one side is seen as a continuous coloured thread and when viewed from an opposite side appears as a metallised thread with demetallised coloured indicia and at the activation temperature or above both sides of the thread are seen as metallised thread having colourless demetallised indicia.

In a second preferred embodiment one or both sides of the substrate have a metallised coating, which is partially demetallised to produce indicia, and the coating containing the thermochromic material is provided on both sides of the metallised coating, such that when the thermochromic material becomes colourless the demetallised indicia are revealed.

The coating containing the thermochromic material may be applied as printed indicia to the substrate, such that at the activation temperature or above the printed indicia disappear.

In a third aspect of the invention a security thread is provided for use in security articles, the thread comprising a substrate having a coating on one or both sides of the substrate, the coating containing a thermochromic pigment or dyestuff which is colourless when the temperature of the coating is below an activation temperature and which becomes coloured when the coating is warmed to the activation temperature or above.

Preferably the coating containing the thermochromic material is applied as printed indicia to the substrate such that at the activation temperature or above the coating becomes coloured and the indicia becomes visible.

The coating or coatings are preferably composed of a variety of thermochromic compounds which display differing colours, which compounds are activated at different activation temperatures, such that as the thread is warmed or subsequently cooled it progresses through a pattern of changing colours.

In a preferred embodiment of the invention there is further included on one or both sides of the thread beneath the coating or coatings containing the thermochromic material, a dye or fluorescent material either in the substrate, on the surface of the substrate or in a coating on the surface of the substrate.

The security thread preferably further includes on one or both sides of the thread, above or beneath the coating or coatings containing the thermochromic material, a UV fluorescent or luminescent material either in the substrate, on the surface of the substrate or in a coating on the surface of the substrate.

Preferably the security thread further includes a machine readable feature.

The present invention provides in a further aspect a security paper comprising opposed surfaces for the provision of printing to identify a document formed from the paper, and positioned between the two surfaces of the paper as a security feature a security thread as previously described.

The thread may be wholly embedded between the surfaces of the paper; however, the thread is preferably positioned partially between the surfaces of the paper, portions of which thread being positioned in windows where there are no or virtually no paper fibres on the thread.

The thread preferably has indicia thereon, and the thread is slit to produce registered indicia with respect to the edge of the thread, or unregistered indicia.

The paper is preferably made from synthetic fibres, or from synthetic and natural fibres, or from natural fibres.

The security paper is preferably a laminate of least two sheets with the security thread positioned between the two sheets.

A banknote or other security document may be produced from the security paper.

BRIEF DESCRIPTION OF THE DRAWINGS

The invention will now be described, by way of example only, with reference to the accompanying drawings in which.

DETAILED DESCRIPTION OF THE PREFERRED EMBODIMENTS

Figure 1:
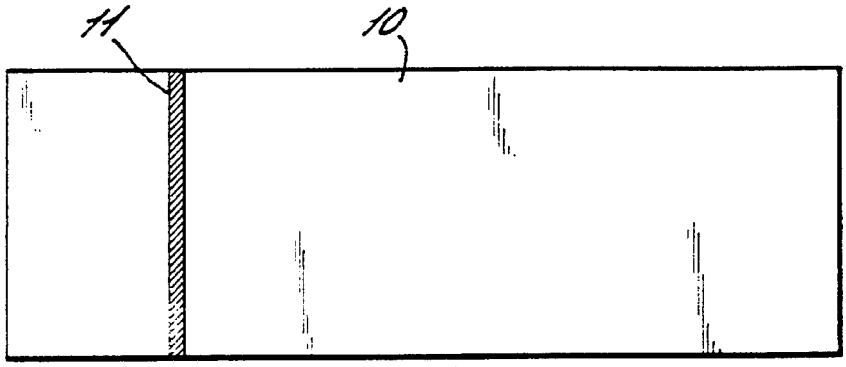
FIG. 1 is a plan view of a sheet of security paper containing a security thread according to the invention viewed in transmitted light at a temperature below the activation temperature.

Referring to FIG. 1, there is shown a sheet of security paper 10, which can be made from synthetic fibres, natural fibres or a combination of synthetic and natural fibres.

Embedded either fully or at least partially within the paper 10 is a security thread 11. The substrate of the thread 11 is preferably a polymeric film such as polyester, e.g. MYLAR (Trade Mark) from DuPont or MELINEX (Trade Mark) from ICI.

The security thread 11 is coated on one or both sides with a formulation containing a thermochromic pigment which, in one embodiment of the invention, is coloured when inactivated, but becomes colourless on warming to its activation temperature. The activation temperature will depend on the pigment being used. Many have activation temperatures of 35° C., but this is not true for all. The coating is applied to a web of the thread substrate prior to slitting and the thickness of the coating may vary from one micron to 10 microns, depending on the strength of visible colour afforded by the pigment.

The coating may be applied, preferably in the form of an ink, by a number of techniques using, for example, a roll coater or alternatively using a printing press by flexographic, offset lithographic or gravure techniques.

Two or more different thermochromic coatings may be applied to the substrate, which have slightly differing activation temperatures and different inactive colours. When blended together, two or more inks may produce a coating such that when warmed to one activation temperature, one ink becomes colourless giving a different base colour; as the temperature increases, the other ink(s) either change colour or become colourless until all inks are activated. At this point the thermochromic coating becomes colourless.

In an alternative embodiment of the invention, a thermochromic coating may be used which has no colour at ambient temperature, and becomes coloured at its activation temperature.

After the coating or coatings have been applied to the substrate and have dried, a further protective lacquer may be applied and also an adhesive to promote bonding of the thread to paper during manufacture.

The web of coated substrate is slit to the desired width and, if required, any lettering or design registered with respect to the edge of the slit thread. The thread is wound onto bobbins containing for example, 6000 meters of thread.

The slit thread may be incorporated into paper by one of a number of known processes. The thread can be sandwiched between two separate paper layers which are laminated together to form the security paper. Alternatively, the thread can be fed into the paper thinstock during paper making and allowing fibres to form paper on either side of the thread. Alternatively, a windowed thread technique using a cylinder mould machine as described in Patent Specification EP 0059056 may be employed producing a defined format of windows 12 visible on the topside of the sheet 10 separated by embedded thread bridges 13. The inclusion of windows 12 in the security paper 10 provides enhanced security for the reasons explained below.

FIG. 1 illustrates the appearance of thread 11 when the paper 10 is viewed in transmitted light at a temperature below the activation temperature of the thread coating. Here the thread 11 is seen as a solid line as the thermochromic pigment is inactive and coloured. A message may be printed on the thread substrate beneath the thermochromic coating. If printed in an ink which has a similar colour to the inactive colour of the thermochromic coating, it would be obscured.

Figure 2:
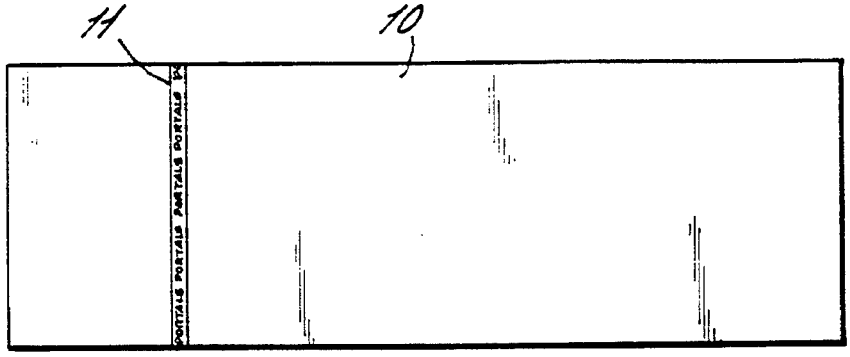
FIG. 2 is a plan view of the security paper of FIG. 1 viewed in transmitted light at a temperature greater than activation temperature.

When the thermochromic coating of the thread 11 is warmed to its activation temperature or above, it becomes colourless. A message printed on the thread substrate beneath the thermochromic coating, which was obscured by the colour of the inactive pigment, now becomes clearly visible in transmitted light as can be seen in FIG. 2.

Figure 3:
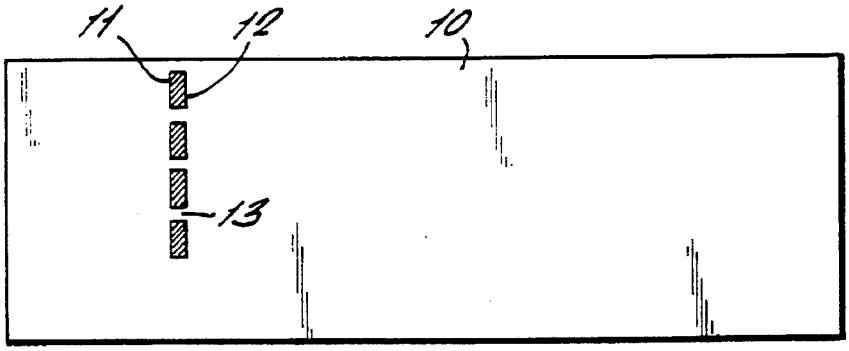
FIG. 3 is a plan view of the security paper of FIG. 1 viewed in reflected light at a temperature below the activation temperature.

In the sample shown in FIG. 3, the security paper 10 is viewed in reflected light at a temperature below the activation temperature. Here, the coloured thread 11 can be seen in the windows 12 in the surface of the paper 10.

Figure 4:
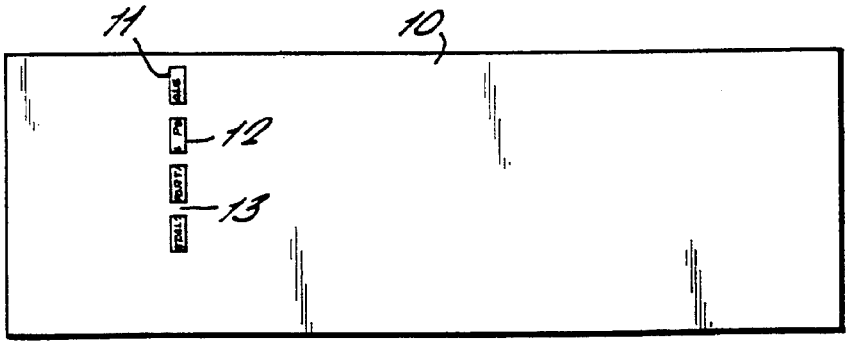
FIG. 4 is a plan view of the security paper of FIG. 1 viewed in reflected light at a temperature greater than the activation temperature.

In FIG. 4, the thermochromic coating is warmed to its activation temperature or above. When viewed in reflected light, the coating has become colourless, thus revealing the message printed on the substrate of the thread 11 in the windows at the surface of the paper 10.

Although the invention can be used without windows the addition of windows in the security paper 10 provides enhanced security as it provides an additional two variations in the optical viewing characteristics. The views shown in FIGS. 1 and 2 will be similar, whether or not windows are included in the paper. The views shown in FIGS. 3 and 4, however, will only be available for windowed paper. In reflected light, a fully embedded thread will not be very visible even when the coating is not activated.

The following are different examples of different security papers in accordance with the invention. It should be noted that the invention is not restricted to security paper.

EXAMPLE 1

A web of 23 mm Mylar film is coated with a semi-transparent magenta coloured thermochromic ink (supplied by SICPA UK). The web is slit to produce 1.2 mm wide thread and wound onto a bobbin. This thread is wholly embedded between opposing surfaces of a sheet of paper during manufacture so that it is completely encased by paper fibres. In reflected light the visibility of the thread is considerably reduced by the overlying paper fibres. In transmitted light the thread appears as a magenta coloured line.

On warming to the activation temperature of 35° C., the thread becomes colourless making it virtually invisible in transmitted light.

EXAMPLE 2

This example utilises a thread made by the procedure described in Example 1, except in that the original Mylar web is coated with a different colour (for example, semi-transparent yellow lacquer) prior to the coating of the thermochromic ink. In reflected light the visibility of the thread is considerably reduced. In transmitted light it appears as a continuous coloured line a blend of magenta and yellow.

On warming to the activation temperature of 35° C., the colour of the thread changes to yellow when viewed under transmitted light.

EXAMPLE 3

This Example utilises a thread made by the procedure described in Examples 1 and 2, except in that the thread is embedded between two paper layers at a nip prior to pressing.

EXAMPLE 4

In this Example the web of Mylar is first printed with a message such as 'VALID' or a name, logo or other indicia in a colour similar to that of the thermochromic ink. The thermochromic ink is subsequently coated over the printed film. The printing may be registered or unregistered whereby, after slitting, the message, name, logo or other indicia appears central to the thread if registered or is staggered in such a way as to ensure that the message is readily seen irrespective of slitting position if unregistered.

When the paper is viewed in reflected light the visibility of the thread is considerably reduced. In transmitted light it appears as a continuous line the colour of the thermochromic ink (see FIG. 1).

On warming to 35° C. the thermochromic ink becomes colourless revealing the message or indicia when viewed in transmitted light (see FIG. 2).

EXAMPLE 5

In this Example the procedure described in Example 4 is followed except in that the message is provided by negative indicia prior to coating with the thermochromic ink.

When the paper is viewed in reflected light, the visibility of the thread is considerably reduced. In transmitted light it appears as a continuous line the colour of the thermochromic ink.

On warming to 35° C. the thermochromic ink becomes colourless revealing the negative microprinted message or indicia when viewed in transmitted light.

EXAMPLE 6

In this Example, the thread is made by the procedure described in Example 1, except in that the thread is embedded in paper having windows at the surface of the paper. In reflected light the thread can be seen in the windows showing the colour of the thermochromic ink with considerable reduction of visibility in the bridges (see FIG. 3). In transmitted light the thread appears as a continuous line the colour of the thermochromic ink.

On warming to 35° C., the thermochromic ink becomes colourless, and in reflected light the windows become virtually invisible. In transmitted light the window and embedded portions of thread become virtually invisible.

EXAMPLE 7

In this Example, the thread is made by the procedure described in Examples 4 and 5 whereby the thread, after slitting, is embedded in paper having windows at the surface of the paper. In reflected light, the thread can be seen in the windows showing the colour of the thermochromic ink with considerably reduced visibility in the bridges. In transmitted light, the thread appears as a continuous line the colour of the thermochromic ink.

On warming to 35° C., the thermochromic ink becomes colourless revealing a partial message or indicia in the windows in reflected light (see FIG. 4) and a continuous message or indicia in transmitted light.

EXAMPLE 8

In this Example, the thread is made according to the procedure described in Example 4, except in that the base thread is of metallised polyester with a demetallised image, message, logo or other indicia as described in Patent Specification EP 0319157. The thread is coated on both sides with thermochromic ink and embedded into paper. In reflected light the visibility of the thread is considerably reduced. In transmitted light the thread appears as a continuous dark line.

On warming to 35° C., the thermochromic ink becomes colourless and the thread appears in transmitted light as a dark line with light lettering or indicia.

EXAMPLE 9

In this Example, the thread is made according to the procedure described in Example 6, except in that the base thread is of metallised polyester with a de-metallised image, message, logo or other indicia. The thread is coated on both sides with thermochromic ink prior to slitting and is embedded in paper having windows. In reflected light, the thread can be seen in the windows having the colour of the thermochromic ink. In transmitted light, the embedded portion of the thread appears as a continuous dark line with negative lettering or indicia the colour of the thermochromic ink.

On warming to 35° C., the thermochromic ink becomes colourless. In reflected light the windows appear grey with light lettering or indicia. In transmitted light they appear as a dark line with clear lettering or indicia.

EXAMPLE 10

The thread in this Example is made by the procedure described in Example 7, except in that the demetallised thread is coated on one side only with thermochromic ink. After embedding in paper, the visibility of the thread in reflected light is considerably reduced. In transmitted light the thread appears as a continuous dark line with faint lettering or indicia the colour of the thermochromic ink.

On warming to 35° C. the thermochromic ink becomes colourless and the lettering or indicia becomes clear and colourless.

EXAMPLE 11

The thread in this Example is made by the procedure described in Example 9, except in that the demetallised thread is coated on one side only with thermochromic ink. In reflected light, if the thread is ink side down, demetallised strips bearing a message, name, logo or other indicia the colour of the thermochromic ink can be viewed in the windows. The visibility of the thread in the embedded bridges is considerably reduced.

If the thread is positioned ink side up, then the thread can be seen in the windows in reflected light showing the colour of the thermochromic ink. The visibility of the thread in the embedded bridges remains considerably reduced.

On warming to 35° C., the thermochromic ink becomes colourless. In reflected light the thread can be viewed in windows as metalised strips with clear lettering or indicia. In transmitted light the thread appears as a continuous dark line with clear lettering or indicia.

EXAMPLE 12

In this Example, the thread is made according to the procedure described in Example 1, except in that the thermochromic ink is printed on the substrate with a message, name, logo or other indicia which in transmitted light reveals the print.

On warming to 35° C., the colour of the printing disappears producing a thread which is virtually invisible.

EXAMPLE 13

The thread in this Example is made by the procedure described in Example 6, except in that the thermochromic ink is printed on the substrate with a message, name, logo or other indicia which is visible in the windows in reflected light and is visible as continuous print in transmitted light.

On warming to 35° C., the colour of the print disappears producing a thread which is considerably less visible in reflected and transmitted light.

EXAMPLE 14

The thread in this Example is made by the procedure described in Examples 12 and 13, except in that the printing with the thermochromic ink produces a negative clear message, name, logo or other indicia surrounded by coloured background.

On warming to 35° C., the thermochromic ink becomes colourless producing a thread which is virtually invisible in reflected and transmitted light.

EXAMPLE 15

The thread of this Example is made by the procedure described in Examples 1 to 8, except in that the thread is coated with a blend of two or more thermochromic compounds in the form of an ink. For example a magenta coloured compound from SICPA UK, which on warming to 35° C., becomes colourless plus a yellow compound from Ubichem Ltd (Code No. R5), which on warming to 50° C. becomes orange.

In the unactivated state the thread appears deep red. On warming to 35° C. the deep red colour disappears and the thread appears yellow. On further warming to 50° C. the thread darkens to an orange colour. If the thread substrate bears microprint letters, message, logo or other indicia which are printed in deep red, they will only be visible when the thread appears yellow or orange.

EXAMPLE 16

The thread of this Example is made by the procedure described in Example 15, except in that the higher temperature thermochromic compound (for example from Ubichem) is compounded into an ink and the substrate is printed with a message, name, logo or other indicia. A lower temperature thermochromic ink (for example magenta from SICPA UK)

is printed over the top.

On warming to 35° C., the magenta ink colour disappears and the yellow print is virtually invisible. On further warming to 50° C. the yellow print turns to orange and becomes more visible.

EXAMPLE 17

In this example, the thread is made according to the procedure described in Examples 1–7, except in that instead of coating the thread with the thermochromic ink, the thermochromic component is incorporated into the substrate prior to slitting.

EXAMPLE 18

The thread in this Example is made according to the procedure described in Examples 1 to 14, except in that the thermochromic compound is colourless at room temperature but becomes coloured on warming.

EXAMPLE 19

In this Example the base substrate includes a holographic, diffractive or colour shift effect.

EXAMPLE 20

In this Example, the thread includes an additional security feature comprising a UV fluorescent dyestuff which is coloured when illuminated with UV light.

EXAMPLE 21

In this Example the thread includes a machine readable feature (for example a magnetic feature) on the thread which allows automatic detection and indentification of a document.

It will be noted from the foregoing that according to this invention there is provided a security thread for use in security articles, said thread comprising a substrate having a coating on one or both sides of the substrate, said coating containing a thermochromic material selected from pigments and dyestuffs which material changes from coloured to colourless when the temperature of said pigment or dyestuff is changed to the activation temperature.

We claim:

1. A security thread for use in security articles, said thread comprising a substrate bearing indicia, the thread having a thermochromic coating on one side of the thread, said thermochromic coating comprising a coating containing a thermochromic material selected from pigments and dyestuffs, which material is coloured when the temperature of said thermochromic coating is below an activation temperature and is colourless when the temperature is at or above said activation temperature, the indicia being obscured when the material is coloured and visible when the material is colourless.

2. A security thread as claimed in claim 1 in which the substrate has a thermochromic coating on both sides of the thread.

3. A security thread as claimed in claim 1 in which said indicia comprise indicia printed on the substrate beneath the thermochromic coating.

4. A security thread as claimed in claim 1 in which one side of the substrate has a metallized coating, which is partially demetallised to form said indicia, and the thermochromic coating is provided on one side of the thread over the metallised coating such that at a temperature below the activation temperature when viewed from one side the thread appears as a continuous coloured line and when viewed from an opposite side appears as a metallised thread with demetallised coloured indicia and at the activation temperature or above both sides of the thread are viewed as metallised thread having colourless demetallised indicia.

5. A security thread as claimed in claim 1 in which one side of the substrate has a metallised coating, which is partially demetallised to form said indicia, and the thermochromic coating is provided on the one side of the thread over the metallised coating and on the other side of the thread, such that when the thermochromic material is colourless the demetallised indicia are visible.

6. A security thread as claimed in claim 1 in which the indicia are printed on the substrate with an ink comprising a thermochromic material.

7. A security thread as claimed in claim 1 in which the thermochromic coating is composed of a variety of thermochromic compounds which display differing colours, which compounds are coloured or clear at different activation temperatures, such that as the thread is warmed or subsequently cooled it progresses through a pattern of changing colours.

8. A security thread as claimed in claim 1 further including, a fluorescent dye or material in the substrate.

9. A security thread as claimed in claim 1 further including, on one side of the thread beneath the thermochromic coating, a UV fluorescent or luminescent material in the substrate.

10. A security thread as claimed in claim 1 which further includes a machine readable feature.

11. A security paper comprising opposed surfaces for the provision of printing to identify a document formed from the paper, and positioned at least partially between the two surfaces of the paper as a security feature a security thread claimed in claim 1.

12. Security paper as claimed in claim 11 in which the thread is wholly embedded between the surfaces of the paper.

13. Security paper as claimed in claim 11 in which the thread is positioned partially between the surfaces of the paper, portions of the thread being positioned in windows where there is no or virtually no paper fibres on the thread.

14. Security paper as claimed in claim 11 in which the thread has indicia thereon, and the thread is slit to produce registered indicia with respect to the edge of the thread, or unregistered indicia.

15. Security paper as claimed in claim 11 wherein the paper is made from fibres selected from synthetic fibres, a mixture of synthetic and natural fibres, and natural fibres.

16. Security paper as claimed in claim 11 wherein said paper is a laminate of two sheets with the security thread positioned between the laminated sheets.

17. A banknote or other security document when produced from the security paper claimed in claim 11.

18. A security thread for use in security articles, said thread comprising a substrate bearing indicia, the thread having a thermochromic coating on one side of the thread, said thermochromic coating comprising a coating containing a thermochromic material selected from pigments and dyestuffs, which material is colourless when the temperature of the thermochromic coating is below an activation temperature and which is coloured when the temperature of the thermochromic coating is at or above the activation temperature, the indicia being visible when the material is colourless and obscured when the material is coloured.

19. A security thread as claimed in claim 18 in which the indicia are printed on the substrate with an ink comprising a thermochromic material.

20. A security thread as claimed in claim 18 in which the thermochromic is composed of a variety of thermochromic compounds which display differing colours, which compounds are activated at different activation temperatures, such that as the thread is warmed or subsequently cooled it progresses through a pattern of changing colours.

21. A security thread as claimed in claim 18 further including a fluorescent dye or material in the substrate.

22. A security thread as claimed in claim 18 further including, on one side of the thread beneath the thermochromic coating, a UV fluorescent or luminescent material in the substrate.

23. A security thread as claimed in claim 18 which further includes a machine readable feature.

24. Security paper comprising opposed surfaces for the provision of printing to identify a document formed from the paper, and positioned at least partially between the two surfaces of the paper as a security feature a security thread claimed in claim 18.

25. Security paper as claimed in claim 24 in which the thread is wholly embedded between the surfaces of the paper.

26. Security paper as claimed in claim 24 in which the thread is positioned partially between the surfaces of the paper, portions of the thread being positioned in windows where there is no or virtually no paper fibres on the thread.

27. Security paper as claimed in claim 24 in which the thread is slit to produce registered indicia with respect to the edge of the thread.

28. Security paper as claimed in claim 24 wherein the paper is made from fibres selected from synthetic fibres, a mixture of synthetic and natural fibres, and natural fibres.

29. Security paper as claimed in claim 24 wherein said paper is a laminate of two sheets with the security thread positioned between the laminated sheets.

30. A banknote or other security document when produced from the security paper claimed in claim 24.

31. Security paper comprising opposed surfaces for the provision of printing to identify a document formed from the paper, and positioned at least partially between the two surfaces of the paper as a security feature a security thread as claimed in claim 1.

32. A security thread as claimed in claim 1 in which the indicia comprise a coloured coating on the substrate beneath the thermochromic coating.

33. A security thread as claimed in claim 18 in which the indicia comprise a coloured coating on the substrate beneath the thermochromic coating.

34. A security thread as claimed in claim 4 in which both sides of the substrate have a partially demetallised metallised coating.

35. A security thread as claimed in claim 5 in which both sides of the substrate have a partially demetallised metallised coating.

36. A security thread as claimed in claim 1 further including a fluorescent dye or material on the surface of the substrate beneath the thermochromic coating.

37. A security thread as claimed in claim 36 further including in fluorescent dye or material on both surfaces of the substrate beneath thermochromic coatings on both sides of the thread.

38. A security thread as claimed in claim 1 further including a fluorescent dye or material in a coating on the surface of the substrate beneath the thermochromic coating.

39. A security thread as claimed in claim 38 further including a fluorescent dye or material in a coating on both surfaces of the substrate beneath thermochromic coatings on both sides of the thread.

40. A security thread as claimed in claim 1 further including a UV fluorescent or luminescent material on the surface of the substrate beneath the thermochromic coating.

41. A security thread as claimed in claim 40 further including a UV fluorescent or luminescent material on both surfaces of the substrate beneath the thermochromic coatings on both sides of the thread.

42. A security thread as claimed in claim 1 further including a UV fluorescent or luminescent material in a coating on the surface of the substrate beneath the thermochromic coating.

43. A security thread as claimed in claim 42 further including a UV fluorescent or luminescent material in coatings on both sides of the substrate beneath thermochromic coatings on both sides of the thread.

44. A security thread as claimed in claim 1 further including a UV fluorescent or luminescent material above the thermochromic coating.

45. A security thread as claimed in claim 44 further including a UV fluorescent or luminescent material on both sides of the thread above thermochromic coatings on both sides of the thread.

46. A security thread as claimed in claim 1 further including a UV fluorescent or luminescent material in a coating above the thermochromic coating.

47. A security thread as claimed in claim 44 further including a UV fluorescent or luminescent material in coatings on both sides of the thread above thermochromic coatings on both sides of the thread.

48. Security paper as claimed in claim 11 in which the thread is slit to produce unregistered indicia.

49. A security thread as claimed in claim 18 in which the thread has a thermochromic coating on both sides thereof.

50. A security thread as claimed in claim 18 further including a fluorescent dye or material on the surface of the substrate beneath the thermochromic coating.

51. A security thread as claimed in claim 50 further including a fluorescent dye or material on both surfaces of the substrate beneath thermochromic coatings on both sides of the thread.

52. A security thread as claimed in claim 18 further including a fluorescent dye or material in a coating on the surface of the substrate beneath the thermochromic coating.

53. A security thread as claimed in claim 52 further including a fluorescent dye or material in a coating on both surfaces of the substrate beneath thermochromic coatings on both sides of the thread.

54. A security thread as claimed in claim 18 further including a UV fluorescent or luminescent material on the surface of the substrate beneath the thermochromic coating.

55. A security thread as claimed in claim 54 further including a UV fluorescent or luminescent material on both surfaces of the substrate beneath thermochromic coatings on both sides of the thread.

56. A security thread as claimed in claim 18 further including a UV fluorescent or luminescent material in a coating on the surfaces of the substrate beneath the thermochromic coating.

57. A security thread as claimed in claim 56 further including a UV fluorescent or luminescent material in coatings on both sides of the substrate beneath thermochromic coatings on both sides of the thread.

58. A security thread as claimed in claim 18 further including a UV fluorescent or luminescent material above the thermochromic coating.

59. A security thread as claimed in claim 58 further including a UV fluorescent or luminescent material on both sides of the thread above thermochromic coatings on both sides of the thread.

60. A security thread as claimed in claim 24 further including a UV fluorescent or luminescent material in a coating above the thermochromic coating.

61. A security thread as claimed in claim 18 in which said indicia comprise indicia printed on the substrate beneath the thermochromic coating.

62. A security thread for use in security articles, said thread comprising a substrate bearing indicia, the substrate incorporating a thermochromic material selected from pigments and dyestuffs, which material is coloured when the temperature of the substrate is below an activation temperature and is colourless when the temperature is at or above said activation temperature, the indicia being obscured when the material is coloured and visible when the material is colourless.

63. A security thread for use in security articles, said thread comprising a substrate bearing indicia, the substrate incorporating a thermochromic material selected from pigments and dyestuffs, which material is colourless when the temperature of the substrate is below an activation temperature and is coloured when the temperature is at or above said activation temperature, the indicia being obscured when the material is coloured and visible when the material is colourless.

* * * * *